US006132858A

United States Patent [19]

Kloos

[11] Patent Number: 6,132,858

[45] **Date of Patent: *Oct. 17, 2000**

[54] MEMBRANE COATED PAPER

[75] Inventor: Steven D. Kloos, Chanhassen, Minn.

[73] Assignee: Omonics, Inc., Minnetonka, Minn.

[ * ] Notice: This patent issued on a continued prosecution application filed under 37 CFR 1.53(d), and is subject to the twenty year patent term provisions of 35 U.S.C. 154(a)(2).

[21] Appl. No.: 08/789,050

[22] Filed: Jan. 28, 1997

[51] Int. Cl.[7] ..... B41M 5/00

[52] U.S. Cl. ..... 428/304.4; 428/195

[58] Field of Search ..... 428/195, 304.4, 428/308.4, 314.8, 315.5, 315.9, 332, 412, 473.5, 474.4, 474.9, 480, 481, 535, 537.5

[56] References Cited

U.S. PATENT DOCUMENTS

| | | | |
|---|---|---|---|
| 4,024,548 | 5/1977 | Alonso et al. | 346/140 R |
| 4,154,899 | 5/1979 | Hershey et al. | 428/537 |
| 4,269,891 | 5/1981 | Minagawa | 428/335 |
| 4,340,479 | 7/1982 | Pall | 210/490 |
| 4,460,637 | 7/1984 | Miyamoto et al. | 428/212 |
| 4,780,356 | 10/1988 | Otouma et al. | 428/212 |
| 4,785,313 | 11/1988 | Higuma et al. | 346/135.1 |
| 4,877,688 | 10/1989 | Senoo et al. | 428/522 |
| 4,879,148 | 11/1989 | Neaves et al. | 428/40 |
| 4,946,741 | 8/1990 | Aono et al. | 428/336 |
| 4,954,395 | 9/1990 | Hasegawa et al. | 428/318.4 |
| 4,988,572 | 1/1991 | Butters et al. | 428/413 |
| 5,002,825 | 3/1991 | Mimura et al. | 428/315.5 |
| 5,104,730 | 4/1992 | Misuda et al. | 428/304.4 |
| 5,108,607 | 4/1992 | Kraus et al. | 210/500.39 |
| 5,264,275 | 11/1993 | Misuda et al. | 428/304.4 |
| 5,374,475 | 12/1994 | Wälchli | 428/304.4 |
| 5,443,727 | 8/1995 | Gagnon | 210/490 |
| 5,445,868 | 8/1995 | Harasawa et al. | 428/206 |
| 5,463,178 | 10/1995 | Suzuki et al. | 428/216 |
| 5,472,773 | 12/1995 | Misuda et al. | 428/195 |
| 5,570,120 | 10/1996 | Sakaki et al. | 347/105 |
| 5,605,750 | 2/1997 | Romano et al. | 428/195 |

*Primary Examiner*—Pamela R. Schwartz
*Attorney, Agent, or Firm*—Kinney & Lange

[57] ABSTRACT

The present invention is a printing medium for use with an ink jet printer. The printing medium includes a substrate and a porous coating layer formed on the substrate using a phase inversion technique. The porous coating layer draws at least one component of an ink solution placed on the porous coating layer into the porous coating layer to dry the ink solution on the porous coating layer.

35 Claims, No Drawings

MEMBRANE COATED PAPER

BACKGROUND OF THE INVENTION

The present invention is a membrane coated substrate. More particularly, the present invention is a membrane coated paper suited for use with a color ink jet printer.

In recent years there have been advances in printing technology that permit the production of high resolution color images through ink jet printing. These advances make it possible for a user to record a color image in a digital format, transfer the image to a computer, manipulate the image, and then print the image on an ink jet printer. Current digital imaging systems are now capable of producing near photographic quality color images.

Improvements in the quality of color images produced by ink jet printers have resulted from developments in the components of the ink jet printer, such as printing heads, as well as advances in the ink compositions used in the ink jet printers. As a result of these developments in color ink jet printing, a new factor limiting the resolution and appearance of color images produced by ink printers has emerged. This limiting factor is the media on which the image is printed.

Using uncoated paper for ink jet printing produces less than optimum resolution because fibers in the paper cause the ink to "run." Additionally, uncoated papers are typically not glossy and therefore do not give photographic quality output.

In attempt to improve the performance of paper used with ink jet printers, a plastic layer has been extruded on the surface of the paper. The extruded plastic layer can give enhanced gloss, smoothness, and general appearance and is typically coated with materials that help to prevent the ink from running.

A drawback of extruded plastic paper coatings is that they typically have little or no porosity or liquid absorptivity. Consequently, the surface of these papers remain wet to the touch for an extended period of time as the ink drying mechanism is mainly due to evaporation of the ink solvent, which is frequently water. It may take ten minutes or more for the images to completely dry, depending on the temperature and humidity. Because of this lengthy drying time, each printed sheet must be removed from the printer tray and set out to dry to prevent smudging or carryover of the printed image onto the back side of the next printed sheet. Also, this extended period of wet ink on the paper surface makes it more likely that the ink will run, lowering image quality.

Another attempt to improve the performance of paper used with ink jet printers involves placing a porous coating on a support medium. The porous coating enhances ink absorption and thereby reduces the ink dry times. For example, Hershey et al., U.S. Pat. No. 4,154,899, describes a coating having a high solids content that is primarily formed from one or more pigments, one or more adhesives, and a small amount of other additives, such as anti-foaming agents.

It has also been disclosed to use inorganic particles to impart porosity to the porous coating. For example, Miyamoto et al., U.S. Pat. No. 4,460,637, describes forming the coating with an upper layer and a lower layer. The upper layer has a pore radius distribution of between 0.2 and 10 micrometers. The lower layer has a pore radius distribution of less than 0.05 micrometers. The Miyamoto et al. coating is prepared by mixing granular pigments with a polymeric binder and then casting the coating on a substrate.

Otouma et al., U.S. Pat. No. 4,780,356, discloses a porous membrane coated ink absorbent paper created by coating a mineral/binder combination on paper, in which the mineral particles themselves can be porous. Otouma et al. indicates that the porosity arises from the minerals particles themselves as well as from pore channels in some spaces between the mineral particles.

Misuda et al., U.S. Pat. No. 5,104,730, describes forming a silica layer on top of a porous coating, which is fabricated from porous particles in a polymeric binder. Misuda et al., U.S. Pat. No. 5,264,275, discusses forming a two-layer coating in which a lower layer has a smaller pore size and an upper layer has a larger pore size.

Suzuhi et al., U.S. Pat. No. 5,463,178, discloses forming a porous coating from pseudo-boehmite and then applying a scratch resistant uppermost layer of silica gel. Misuda et al., U.S. Pat. No. 5,472,773, describes producing a high gloss porous coated paper by first casting a porous layer from a pseudo-boehmite containing liquid on a smooth plastic sheet. A paper backing is then applied to the porous layer. Finally, the plastic sheet is separated from the porous layer to reveal the coated paper.

Others have found that ink absorbent coatings for ink jet recording media can be prepared using coatings that are free from inorganic filler particles. However, particles are still required in those methods to produce a porous coating. For example, Wälchli, U.S. Pat. No. 5,374,475, describes preparing a polymeric solution and then adding a non-solvent to create microscopically small polymer particles. This polymer solution containing the microscopically small polymer particles is cast on a support media and then heat-treated to evaporate the solvents.

Yet another mechanism for improving the performance of media used with ink jet printers involves applying a low porosity ink absorbent coating to the media, such as is described in Senoo et al., U.S. Pat. No. 4,877,688. In Senoo et al., the coating is fabricated by layering a polymeric emulsion on a plastic substrate. Hasegawa et al., U.S. Pat. No. 4,954,395, discloses sandwiching an ink receiving layer between a non-porous polyester film and a porous coating, where the porous coating is formed from a coating mixture containing polymer micro-particles.

SUMMARY OF THE INVENTION

The present invention relates to a printing medium for use with an ink jet printer. The printing medium includes a substrate and a porous coating layer formed on the substrate using a phase inversion technique. The porous coating layer draws at least one component of an ink solution placed on the porous coating layer into the porous coating layer to dry the ink solution on the porous coating layer.

DETAILED DESCRIPTION OF THE PREFERRED EMBODIMENTS

The present invention includes a membrane coated substrate and a method of fabricating the membrane coated substrate. The membrane coated substrate provides advantageous performance characteristics when used in conjunction with an ink jet printer. As used herein, the term "advantageous performance characteristics" means that the membrane coated substrate provides near photographic quality images where the resolution is not degraded by ink or solvent components of an ink solution running on the surface of the membrane coated substrate and where at least one component of the ink solution is drawn into the coated substrate to provide a dry surface.

Additionally, as an image is printed on the membrane coated substrate using a conventional ink jet printer, the porous structure of the membrane causes at least one component of the ink solution used to form the image to dry in less than about 10 seconds. Because the ink solution dries in less than about 10 seconds, an operator does not have to manually remove each of the printed images from the printer to prevent smearing or smudging of the image caused by contact between adjacent images.

The advantageous performance characteristics of the present invention are believed to result from the structure of the porous layer. The structure of the porous coating layer is preferably produced using a phase inversion technique. The phase inversion technique used in producing the porous coating layer of the present invention is similar to the phase inversion techniques used in fabricating non-composite reverse osmosis membranes, nanofiltration membranes, ultrafiltration, and microfiltration membranes.

The phase inversion casting process preferably entails coating a polymeric dope solution onto a substrate. The coated substrate is then quenched in a non-solvent, such as water, to produce a microporous structure. When analyzed, it is found that the microporous structure consists of random, interconnecting pore channels.

Unlike the prior art porous coatings that require the addition of particles to impart porosity, the porous coating layer of the present invention does not require the addition of particles. Furthermore, it is typically desirable to filter the polymeric dope solution to remove any particles in order to reduce defects in the porous coating layer.

While it is not necessary to incorporate particles into the polymeric dope solution to impart a desired degree of porosity to the porous coating, it is possible to add particles to the polymeric dope solution to impart a selected physical characteristic to the porous coating. For example, incorporating pigment particles into the polymeric dope solution can be used to reduce the amount of light transmission through the porous coating layer.

One important criteria in obtaining a porous layer coated substrate with ink solution dry times of less than about 10 seconds is the pore size of the porous layer. While porous coatings having pore sizes of less than about 0.05 micrometers exhibit superior ink solution dry times to non-porous coatings, fabricating the porous coating layer with an average pore size of greater than 0.05 micrometers is generally needed to provide ink solution dry times of less than 10 seconds. Preferably, the pore size of the porous coating layer is between about 0.1 and 10 micrometers.

Another important criteria in obtaining a porous layer coated substrate with ink solution dry times of less than about 1 second is the water permeability of the porous layer. The water permeability of the porous layer is important because the water permeability relates to the ability of the porous layer to absorb liquids until the upper surface of the porous coating layer is dry.

One common measure of water permeability is referred to as the "A" value. The "A" value is calculated using the following formula:

$$A = \frac{\text{permeated water (ml)}}{[\text{coating area (m}^2)]\ [\text{test time (sec)}]\ [\text{driving force (atm)}]}$$

One suitable apparatus for measuring permeability is the Sepa ST test cell, which can be obtained from Osmonics, Inc. of Minnetonka, Minn.

The porous coating layer of the present invention preferably has a water permeability of greater than about 30 $ml/m^2 \cdot sec \cdot atm$. Even more preferably, the porous layer preferably has a water permeability of between about 120 and 700 $ml/m^2 \cdot sec \cdot atm$.

The polymeric dope solution used for fabricating the porous coating layer preferably contains components selected from four general categories: polymers, solvents, non-solvents, and other additives. It is possible to use a variety of polymers in formulating the polymeric dope solution. Suitable polymers include cellulose, cellulose acetates, cellulose nitrates, polysulfones, polyethersulfones, polyamides, polyimides, nylons, polyacrylates, polyesters, polyvinylidenefluorides, polycarbonates, polyurethanes, and polyacrylonitriles. The concentration of polymer in the polymeric dope solution is preferably between about 3 and 25 percent by weight.

The concentration of solvent in the polymeric dope solution is preferably between about 35 and 75 percent by weight. The solvent is selected based on the ability of the solvent to completely dissolve the polymer. It is possible to use a particular solvent by itself or in combination with other solvents. A preferred solvent for use with cellulose diacetate is acetone. Other suitable solvents for use in the present invention include: other liquid aliphatic acids, such as acetic acid and propionic acid, and halogenated aliphatic acids, such as trichloroacetic acid, trichloropropionic acid, chloroacetic acid, and dichloroacetic acid; phenols such as phenol; creosols and their halogenated derivatives; saturated aqueous or alcohol solutions of alcohol soluble salts, such as calcium chloride, magnesium chloride and lithium chloride; hydroxylic solvents including halogenated alcohols, benzyl alcohol, and polyhydric alcohols such as ethylene glycol, propylene glycol, and glycerol; N-methyl pyrrolidinone, N,N-dimethylacetamide, methylene chloride, chloroform, tetrahydrofuran, and polar aprotic solvents such as ethylene carbonate, diethyl succinate, dimethyl sulfoxide and dimethyl formamide.

Because porous coatings can be sensitive to loss of moisture that could cause collapse of the capillary pore structure and consequently loss of ink absorbency, it may be desirable to incorporate a drying agent into the polymeric dope solution that remains in the coating after removal of water. Alternatively, a drying agent can be incorporated by use of an additional coating step. Suitable drying agents include hydrophilic materials, such as surfactants, organic and inorganic salts, polyethylene glycols, glycerin, monomeric glycols, and water soluble polymers. A suitable drying agent for use in a cellulose diacetate and acetone solution is propylene glycol. The concentration of the drying agent in the polymeric dope solution is preferably up to about 50 percent by weight.

It may also be desirable to add other agents directly to the polymeric dope solution to further enhance ink retention, or provide a specific color, gloss, opacity. In certain polymeric dope solution formulations, it may be desirable to add an anti-foaming or defoaming agent to the polymeric dope solution.

Preferred non-solvents are those that are capable of causing the polymer in the polymeric dope solution to aggregate. Suitable non-solvents includes alcohols, such as methanol, ethanol, isopropanol, propanol, butanol, t-butanol, pentanol, phenol, and their derivatives; lactones, such as gamma-butyrolacetone; pyrrolidinones such as n-methyl pyrrolidinone; glycerine; glycols, such as ethylene glycol, propylene glycol, and polyethylene glycol; triethyl phosphate; amides such as formamide and dimethyl formamide; dimethyl sulfoxide; water; ethers such as diethyl ether and tetrahydrofuran; nitriles such as acetonitrile and butyronitrile; dioxane;

organic acids, such as acetic acid, citric acid, and formic acid; inorganic salts, such as calcium chloride, magnesium chloride, zinc chloride, lithium chloride, magnesium sulfate, calcium sulfate, and sodium sulfate. Depending on the volatility of the solvent used in the polymeric dope solution, air or humidified air may also be used as the non-solvent.

The porous coatings may be formed on a variety of substrates because the properties of the porous coatings are not necessarily derived from the substrate on which the porous coatings are formed. The selection of a substrate is primarily based on the application in which the coated media is to be used. Examples of suitable substrates are paper, high wet strength paper, woven fabrics, and non-woven fabrics, such as those commonly made from polyester and polypropylene. One preferred substrate for use with the present invention is high wet strength paper marketed by Permafiber Corporation of Holyoke, Mass.

The thickness of the substrate is believed to be unrelated to the performance of the porous coating placed on the substrate. For most printing applications, the substrate has a thickness of between 0.05 and 0.001 inches.

In certain circumstances, it may be desirable to treat the surface of the substrate to enhance the adhesion of the porous coating to the substrate, such as by roughening the surface of the substrate. One suitable surface treatment techniques is a corona treatment.

The dope casting solution is preferably prepared by first dissolving the polymer and any solid additives in approximately 70 to 90 percent of the solvent using an air mixer. Once the polymer is completely dissolved, the remaining solvent and other additives are slowly added under stirring conditions.

Where the polymeric dope solution has a relatively low volatility, the polymeric dope solution is degassed under a partial vacuum. When the volatility of the polymeric dope solution is higher, degassing is allowed to occur naturally over a period of between 4 and 40 hours, or longer if a viscosity of the solution is greater than 3,000 centipoise.

Depending on the purity of the dope solution, it may be desirable to filter the polymeric dope solution. After degassing and filtering are completed, the polymeric dope solution is metered onto a substrate using a dope applicator. Suitable dope applicators include a knife over roll or a slot die extrusion assembly.

The thickness of the porous coating is not necessarily a controlling factor and the optimum thickness of the porous coating is related to the substrate on which the porous coating is formed and the application to which the coated substrate is to be used. For example, on substrates with little or no ink absorptivity, the porous coating is preferably thicker than where the porous coating is formed on a highly absorptive substrate. Additionally, the thickness of the porous coating may be varied to control the amount of light transmitted to the substrate. For most substrates and applications, the porous coating has a thickness of less than 0.020 inches. Preferably, the thickness of the porous coating is between about 0.0005 and 0.010 inches.

Next, the coated substrate is preferably passed through a water-filled quench tank to solidify the dope solution through phase inversion. When the solvent used in formulating the polymeric dope solution has considerable volatility, it is possible for the polymeric composition to phase invert on the substrate without the aid of a quenching fluid. A preferred solvent for producing phase inversion without the use of a quenching fluid is acetone.

After the coated substrate exits the quench tank, the coated substrate is preferably dried to remove any water absorbed during the phase inversion process. A variety of techniques can be used in drying the coated substrate, such as air knifes, squeegee blades, vacuum rollers, and sponges. Preferably, the drying is performed by a process that does not involve physically touching the coated substrate to prevent scratching of the coating. To assist in drying the coated substrate, it is also possible to use reduced pressure, rapid air flow, infrared heat, convective heat, or combinations thereof.

As an alternative to the method for forming the porous coating layer described above, a person of ordinary skill in the art will appreciate that other techniques that produce a phase inversion, such as sol gel phase inversion, will also result in a membrane coated substrate having the desirable characteristics described herein.

A person of ordinary skill in the art will appreciate that it is possible to use additional coating layers in conjunction with the porous coating layer without deviating from the present invention. For example, it is possible to form a porous coating layer on both sides of the substrate. It is also possible to enhance the adhesion of the porous coating layer to the substrate by placing a receiver layer between the substrate and the porous coating layer. Placing the receiver layer between the substrate and the porous coating layer may also enhance the retention of ink in the porous coating layer. The receiver layer may also be placed on top of the porous coating layer to enhance the ink adhesion and drying properties. Alternatively, it is possible to enhance the gloss or ink adhesion of the porous membrane coated substrate by applying a layer on top of the porous coating layer.

EXAMPLES

To illustrate the performance of membrane coated substrates prepared according to the present invention, the following membrane coated substrates were prepared. The performance of the membrane coated substrates were evaluated based upon several criteria including ink absorbency, pore size, and water permeability.

The ink absorbency was evaluated using ink from a marker or from an aqueous dye. When the ink absorbency of the marker was evaluated, the marker was moved over the porous coating to draw a line on the porous coating. When the ink absorbency of the aqueous dye was evaluated, a drop of the aqueous dye was placed on the porous coating.

The ink absorbency was classified as excellent if the ink dry time was less than 1 second, very good if the ink dry time was between about 1 and 5 seconds, good if the ink dry time was between about 5 and 10 seconds, and poor if the ink dry time was greater than 10 seconds. Where the ink was not absorbed by the coated paper sample, the absorptivity was classified as no absorption.

The pore size was calculated using a bubble point apparatus. The water permeability of the membrane coated substrates was evaluated by calculating the "A" value of the porous membrane.

In addition to the preceding objective evaluations, the gloss and finish of the membrane coated substrates were also evaluated. These tests involved a subjective classification of the gloss and finish of the membrane coated substrates as either excellent, good or poor. An excellent gloss appeared similar to a glossy photograph while a poor gloss appeared non-glossy similar to an uncoated sheet of paper. An excellent finish appeared uniform to the naked eye while a poor finish had visible irregularities.

Example 1

A polymeric dope solution was prepared using a mixture of cellulose diacetate, acetone, and propylene glycol having concentrations of approximately 9.6, 44.4, and 46.0 percent by weight, respectively. The polymeric dope solution was prepared using a two-step process. In the first step, the cellulose diacetate was dissolved in about 80 percent by weight of the acetone.

Once the cellulose diacetate was completely dissolved, the remaining acetone and the propylene glycol were slowly mixed into the polymeric dope solution. The polymeric dope solution was then allowed to degas. Next, the polymeric coating solution was filtered through a bag filter to remove any particulate impurities. The polymeric dope solution exhibited a viscosity of approximately 1050 centipoise.

The polymeric dope solution was metered onto a continuous paper web using a knife over roll coating apparatus having a gap of approximately 7 mil. The coated paper web was then passed through a water filled quench tank that was maintained at a temperature of about 50° F. The water caused the polymeric dope solution to phase invert and thereby form a solid porous coating on the paper web. Upon exiting the quench tank, excess water was removed from the coated paper web with an air knife. The cured coated paper web was then dried using infrared heat.

Samples from the cured coated paper web were examined for performance characteristics. It was found that the propylene glycol was not completely washed out of the porous coating. It is believed that the use of propylene glycol in the polymeric coating solution helped to maintain the large pore sizes exhibited by the coating in this Example because the propylene glycol acted as a drying agent to prevent pore collapse during the infrared drying.

When analyzed using a bubble point test, the polymeric coating on the sample exhibited a pore size of about 0.61 microns. The water permeability of the polymeric coating was approximately 190 $ml/m^2 \cdot sec \cdot atm$. The ink absorptivity was excellent, the appearance of the sample was good, and the gloss of the sample was moderate.

Example 2

The process described in Example 1 was repeated using a polymeric dope solution having the following components: cellulose diacetate (about 11.0 percent by weight), acetone (about 44.4 percent by weight), and propylene glycol (about 44.6 percent by weight). The polymeric dope solution exhibited a viscosity of approximately 1806 centipoise.

The polymeric coating solution was cast onto a polyester substrate using a knife over roll coating apparatus with a gap of approximately 7 mil. The coated polyester substrate was then passed through a water filled quench tank to solidify the coating solution on the polyester substrate through phase inversion.

Samples from the coated polyester substrate were then examined for performance characteristics. Similar to Example 1, it was found that the propylene glycol was not completely washed out of the porous coating.

When analyzed using a bubble point test, the polymeric coating on the sample exhibited a pore size of about 0.48 microns. The water permeability of the polymeric coating was approximately 174 $ml/m^2 \cdot sec \cdot atm$. The ink absorptivity of this sample was excellent.

Example 3

The process described in Example 1 was repeated using a polymeric coating solution having the following components: cellulose diacetate (about 9.6 percent by weight), titanium dioxide (about 5.0 percent by weight), acetone (about 43.2 percent by weight), propylene glycol (about 42.0 percent by weight), and non-ionic surfactant (about 0.2 percent by weight) The polymeric coating solution exhibited a viscosity of about 1140 centipoise.

The polymeric coating solution was then metered on a polyethylene substrate using a knife over roll coating apparatus with a gap of approximately 7 mil. The coated polyethylene substrate was then passed through a water filled quench tank to solidify the coating solution on the polyethylene substrate through phase inversion.

Samples from the coated polyethylene substrate were then examined for performance characteristics. Similar to the preceding Examples, it was found that the propylene glycol was not completely washed out of the porous coating.

When analyzed using a bubble point test, the polymeric coating on the sample exhibited a pore size of about 1.81 microns. The titanium dioxide used in this example contained about 25 percent by weight water. As such, the use of 5.0 percent by weight titanium dioxide actually represents the addition of approximately 3.75 percent by weight titanium dioxide and about 1.25 percent by weight water. Because water is a strong non-solvent for cellulose diacetate/acetone formulations, this addition of water probably played a minor role in achieving the large pore sizes exhibited by these samples.

The use of titanium dioxide in the polymeric coating solution produced a more opaque coating. However, the titanium dioxide did not appear to overly affect the pore size in the porous coating.

The water permeability of the polymeric coating was approximately 165 $ml/m^2 \cdot sec \cdot atm$. The ink absorptivity of this sample was excellent.

Example 4

The process and compositions set forth in Example 3 were repeated in this Example except that the polymeric coating solution was cast onto a paper web using a slot dry extrusion coating head. The quench tank used for causing phase inversion of this sample was filled only with air. As such, evaporation of acetone was the primary cause of phase inversion. The ink absorptivity of this sample was very good. The appearance of the porous coating was inferior to the appearance of the porous coatings in Example 3.

Comparative Example 1

A paper web was coated with a polysulfone composition that was designed to produce an average molecular weight cut-off between about 20,000 and 30,000 daltons, which approximately corresponds with a pore size of between 0.008 to 0.012 microns. The polysulfone coating was applied at approximately the same thickness as the thickness of the coating of the present invention.

While the polysulfone coated paper web had an excellent gloss and finish, the polysulfone coated paper web displayed ink dry times of greater than 10 seconds. The polysulfone coating exhibited a water permeability of about 45 $ml/m^2 \cdot sec \cdot atm$.

Comparative Example 2

The polysulfone composition from Comparative Example 1 was coated on a polyethylene substrate. Similar to the results in Comparative Example 1, the polysulfone coated polyethylene substrate had an excellent gloss and finish and displayed ink dry times of greater than 10 seconds. The polysulfone coating exhibited a water permeability of about 45 $ml/m^2 \cdot sec \cdot atm$.

Comparative Example 3

The process of Comparative Example 1 was repeated using a polysulfone composition that was designed to produce an average molecular weight cut-off of between about 50,000 and 70,000 daltons, which approximately corresponds with a pore size of between about 0.020 and 0.028 microns.

This polysulfone composition also produced a polysulfone coated paper web with excellent gloss and finish characteristics. However, the polysulfone coated paper web displayed ink dry times of greater than 10 seconds. The polysulfone coating exhibited a water permeability of about 80 ml/m$^2$·sec·atm.

Comparative Example 4

The polysulfone composition from Comparative Example 3 was coated on a polyethylene substrate. Similar to the results in Comparative Example 3, the polysulfone coated polyethylene substrate had an excellent gloss and finish and displayed ink dry times of greater than 10 seconds. The polysulfone coating exhibited a water permeability of about 80 ml/m$^2$·sec·atm.

Comparative Example 5

A cellulose triacetate composition was coated on a paper web using the process set forth in Comparative Example 1. The cellulose triacetate used in this Example was designed to yield an average molecular weight cut-off of about 10,000 daltons, which approximately corresponds with a pore size of between about 0.002 and 0.006 microns.

The cellulose triacetate coated paper web exhibited an excellent finish and very good gloss. However, the ink dry times for the cellulose triacetate coated paper web were greater than 10 seconds.

Comparative Example 6

A cellulose diacetate composition was coated on a paper web using the process set forth in Comparative Example 1. The cellulose diacetate used in this Example was designed to yield an average molecular weight cut-off of between about 60,000 and 80,000 daltons, which approximately corresponds with pore size of between about 0.024 and 0.032 microns. After the cellulose diacetate composition was cast onto the paper web, the coated paper web was dried with infrared heat. This cellulose diacetate coating exhibited a water permeability of 65 ml/m$^2$·sec·atm.

The cellulose diacetate coated paper web exhibited a nice finish and a fair gloss. The ink dry times for the cellulose diacetate coated paper web were between 7 and 15 seconds.

It has surprisingly been found, as illustrated by the preceding Examples and Comparative Examples, that the membrane coated substrates produced according to the present invention have short ink dry times as well as desirable finish and gloss characteristics. Membranes exhibiting these characteristics preferably have average pore sizes of between about 0.1 and 10 micrometers and water permeabilities of greater than about 120 ml/m$^2$·sec·atm.

Unlike the membrane coated substrates set forth in the Comparative Examples, ink placed on membrane coated substrates produced according to the present invention dries in less than 1 second. Additionally, the membrane coated substrates produced according to the present invention have desirable appearance and gloss characteristics such that membrane coated substrates are capable of producing color near photographic quality images.

Although the present invention has been described with reference to preferred embodiments, workers skilled in the art will recognize that changes may be made in form and detail without departing from the spirit and scope of the invention.

What is claimed is:

1. A printing medium for use with an ink jet printer, the printing medium comprising:

a substrate; and a porous coating layer formed on the substrate using a particle-free phase inversion technique in which a polymeric dope solution containing a polymer completely dissolved in a solvent is coated on the substrate and then subjected to a non-solvent quench which causes the polymeric dope solution to phase invert to form a porous capillary structure;

wherein the porous coating layer has average pore sizes between about 0.1 and about 10 micrometers and a water permeability greater than about 120 ml/m$^2$·sec·atm; and wherein when an ink solution is placed upon the porous coating layer, at least one component of the ink solution is drawn into the porous coating layer to dry the ink solution on the porous coating layer in less than about 10 seconds.

2. The printing medium of claim 1, wherein the ink solution dries in less than about 1 second.

3. The printing medium of claim 1, wherein the porous coating layer is fabricated from a polymeric dope solution that comprises a polymer, a solvent, and a non-solvent.

4. The printing medium of claim 3, wherein the polymer is cellulose, cellulose acetate, cellulose nitrate, polysulfone, polyethersulfone, polyamide, polyimide, nylon, polyacrylate, polyester, polyvinylidenefluoride, polycarbonate, polyurethane, polyacrylonitrile, or combinations thereof.

5. The printing medium of claim 4, wherein the concentration of the polymer in the polymeric dope solution is between about 3 and 25 percent by weight.

6. The printing medium of claim 4, wherein the solvent is acetone, dimethyl formamide, N-methyl pyrrolidinone, N,N-dimethyl acetamide, dimethyl sulfoxide, methyl ethyl ketone, tetrahydrofuran, dichloromethane, formamide, or acetonitrile.

7. The printing medium of claim 6, wherein the concentration of the solvent in the polymeric dope solution is between about 35 and 75 percent by weight.

8. The printing medium of claim 3, wherein the polymeric dope solution further comprises a drying agent added to the polymeric dope solution at a concentration of up to about 50 percent by weight.

9. The printing medium of claim 8, wherein the drying agent is a surfactant, organic salt, inorganic salt, polyethylene glycol, glycerin, monomeric glycol, water soluble polymer, or combinations thereof.

10. The printing medium of claim 1, wherein the porous coating layer has a thickness of between about 0.0005 and 0.010 inches.

11. The printing medium of claim 1, wherein the substrate is paper, woven fabric, or non-woven fabric.

12. The printing medium of claim 1, wherein the substrate has a thickness of between about 0.05 and 0.001 inches.

13. A membrane coated substrate for use with an ink jet printer, the membrane coated substrate comprising:

a substrate;

a particle-free porous coating layer formed on the substrate using a phase inversion technique in which a polymeric dope solution containing a polymer completely containing a polymer completely dissolved in a solvent is coated on the substrate and then subjected to a non-solvent quench which causes the polymeric dope solution to phase invert to form a porous capillary structure, wherein the porous coating layer has an average pore size of between about 0.1 and about 10 micrometers;

wherein the porous coating layer has a water permeability of between about 120 and 70 ml/m$^2$·sec·atm;

wherein the porous coating layer has a thickness between about 0.0005 and about 0.010 inches;

wherein the substrate has a thickness of between about 0.001 and about 0.05 inches; and wherein when an ink solution is placed upon the porous coating layer, at least one component of the ink solution is drawn into the porous coating layer to dry the ink solution on the porous coating layer in less than about 10 seconds.

14. The membrane coated substrate of claim 13, wherein the porous coating layer is fabricated from a polymeric dope solution that comprises a polymer, a solvent, and a non-solvent.

15. The membrane coated substrate of claim 14, wherein the polymer is cellulose, cellulose acetate, cellulose nitrate, polysulfone, polyethersulfone, polyamide, polyimide, nylon, polyacrylate, polyester, polyvinylidenefluoride, polycarbonate, polyurethane, polyacrylonitrile, or combinations thereof.

16. The membrane coated substrate of claim 14, wherein the solvent is acetone, dimethyl formamide, N-methyl pyrrolidinone, N,N-dimethyl acetamide, dimethyl sulfoxide, methyl ethyl ketone, tetrahydrofuran, dichloromethane, formamide, or acetonitrile.

17. The membrane coated substrate of claim 14, wherein the porous coating layer further compromises a drying agent added to the polymeric dope solution at a concentration of up to about 50 percent by weight.

18. The membrane coated substrate of claim 17, wherein the drying agent is a surfactant, organic salt, inorganic salt, polyethylene glycol, glycerin, monomeric glycol, water soluble polymer, or combinations thereof.

19. A printing medium for use with an ink jet printer, the printing medium comprising:

a substrate;

a solid particle-free porous polymeric coating fabricated on the substrate, wherein the porous coating layer has pores formed during solidification on the coating layer by a phase inversion produced by a non-solvent fluid quench of a polymeric dope solution containing a polymer completely dissolved in a solvent in a concentration of between about 35 and 75 percent by weight;

wherein the porous coating layer has a water permeability of greater than about 120 ml/m$^2$·sec·atm, and the average pore size is between about 0.1 and about 10 micrometers; and wherein when an ink solution is placed upon the porous coating layer, at least one component of the ink solution is drawn into the porous coating layer to dry the ink solution on the porous coating layer in less than about 10 seconds.

20. The printing medium of claim 19, wherein the porous coating layer is fabricated from a polymeric dope solution that comprises a polymer, a solvent, and a non-solvent.

21. The printing medium of claim 20, wherein the polymer is cellulose, cellulose acetate, cellulose nitrate, polysulfone, polyethersulfone, polyamide, polyimide, nylon, polyacrylate, polyester, polyvinylidenefluoride, polycarbonate, polyurethane, polyacrylonitrile, or combinations thereof.

22. The printing medium of claim 20, wherein the solvent is acetone, dimethyl formamide, N-methyl pyrrolidinone, N,N-dimethyl acetamide, dimethyl sulfoxide, methyl ethyl ketone, tetrahydrofuran, dichloromethane, formamide, or acetonitrile.

23. A printing medium for use with an ink jet printer, the printing medium comprising:

a substrate; and a porous coating layer supported by the substrate and having a thickness of between about 0.0005 and bout 0.010 inches and average pore sizes between about 0.1 and about 10 micrometers formed using a phase inversion technique in which a polymeric dope solution that includes a polymer, a solvent and a drying agent is coated on the substrate and then subjected to a non-solvent fluid quench which causes the polymeric dope solution to phase invert and form the solid porous coating layer on the substrate; wherein the solvent is in an amount sufficient to completely dissolve the polymer and the drying agent is in an amount sufficient to prevent collapse of the capillary pore structure in the porous coating layer during after phase inversion; wherein the porous coating layer has a water permeability greater than about 120 ml/m$^2$·sec·atm; and wherein when an ink solution is placed upon the porous coating layer, at least one component of the ink solution is drawn into the porous coating layer to dry the ink solution on the porous coating layer in less than about 10 seconds.

24. The printing medium of claim 23, wherein the ink solution dries in less than about 1 second.

25. The printing medium of claim 24, wherein the concentration of the polymer in the polymeric dope solution is between about 3 and 25 percent by weight.

26. The printing medium of claim 23, wherein the polymer is cellulose, cellulose acetate, cellulose nitrate, polysulfone, polyethersulfone, polyamide, polyimide, nylon, polyacrylate, polyester, polyvinylidenefluoride, polycarbonate, polyurethane, polyacrylonitrile, or combinations thereof.

27. The printing medium of claim 26, wherein the solvent is acetone, dimethyl formamide, N-methyl pyrrolidinone, N,N-dimethyl acetamide, dimethyl sulfoxide, methyl ethyl ketone, tetrahydrofuran, dichloromethane, formamide, or acetonitrile.

28. The printing medium of claim 27, wherein the concentration of the solvent in the polymeric dope solution is between about 35 and 75 percent by weight.

29. The printing medium of claim 23, wherein the drying agent is a surfactant, organic salt, inorganic salt, polyethylene glycol, glycerin, monomeric glycol, water soluble polymer, or combinations thereof.

30. A membrane coated substrate for use with an ink jet printer, the membrane coated substrate comprising:

a substrate having a thickness of between about 0.001 and bout 0.05 inches; and a polymeric porous coating layer having a capillary pore structure which is supported by the substrate and formed by phase inversion from a polymeric dope solution that includes a polymer, a solvent, and a drying agent; wherein the drying agent is in a concentration in the dope solution sufficient to prevent collapse of the capillary pore structure during drying of the porous coating layer after phase inversion; wherein the porous coating layer has a average pore size of between about 0.1 and about 10 micrometers; wherein the porous coating layer has a water permeability of between about 120 and about 700 ml/m$^2$·sec·atm; wherein the porous coating layer has a thickness between about 0.0005 and 0.010 inches; and wherein when an ink solution is placed upon the porous coating layer, at least one component of the ink solution is drawn into the porous coating layer to dry the ink solution on the porous coating layer in less than about 10 seconds.

31. The membrane coated substrate of claim 30, wherein the polymer is cellulose, cellulose acetate, cellulose nitrate, polysulfone, polyethersulfone, polyamide, polyimide, nylon, polyacrylate, polyester, polyvinylidenefluoride, polycarbonate, polyurethane, polyacrylonitrile, or combinations thereof; wherein the solvent is acetone, dimethyl formamide, N-methyl pyrrolidinone, N,N-dimethyl acetamide, dimethyl sulfoxide, methyl ethyl ketone, tetrahydrofuran, dichloromethane, formamide, or acetonitrile; and wherein the drying agent is a surfactant, organic salt, inorganic salt, polyethylene glycol, glycerin, monomeric glycol, water soluble polymer, or combinations thereof.

32. A printing medium for use with an ink jet printer, the printing medium comprising:

a substrate; and a porous polymeric coating layer supported by the substrate, wherein the porous coating layer has a capillary pore structure pores with an average pore size of between about 0.1 and about 10 micrometers formed during solidification by phase inversion produced by a non-solvent quench of a polymeric dope solution that includes a polymer, a solvent in a concentration of between about 35 and 75 percent by weight and a drying agent in a concentration of up to about 50 percent by weight sufficient to prevent collapse of the capillary pore structure during drying of the porous coating layer after phase inversion; wherein the porous coating layer has a water permeability of greater than about 120 ml/m$^2$·sec·atm, and wherein when an ink solution is placed upon the porous coating layer, at least one component of the ink solution is drawn into the porous coating layer to dry the ink solution on the porous coating layer in less than about 10 seconds.

33. The printing medium of claim 32, wherein the polymer is cellulose, cellulose acetate, cellulose nitrate, polysulfone, polyethersulfone, polyamide, polyimide, nylon, polyacrylate, polyester, polyvinylidenefluoride, polycarbonate, polyurethane, polyacrylonitrile, or combinations thereof.

34. The printing medium of claim 32, wherein the solvent is acetone, dimethyl formamide, N-methyl pyrrolidinone, N,N-dimethyl acetamide, dimethyl sulfoxide, methyl ethyl ketone, tetrahydrofuran, dichloromethane, formamide, or acetonitrile.

35. The membrane coated substrate of claim 32, wherein the drying agent is a surfactant, organic salt, inorganic salt, polyethylene glycol, glycerin, monomeric glycol, water soluble polymer, or combinations thereof.

* * * * *

UNITED STATES PATENT AND TRADEMARK OFFICE

CERTIFICATE OF CORRECTION

PATENT NO. : 6,132,858
DATED : October 17, 2000
INVENTOR(S) : Steven D. Kloos

It is certified that error appears in the above-identified patent and that said Letters Patent is hereby corrected as shown below:

Title page,
Item [73], Assignee: delete "Omonics, Inc.", insert -- Osmonics Inc. --

Column 12,
Line 14, delete "bout", insert -- about --
Line 60, delete "bout", insert -- about --

Signed and Sealed this

Sixteenth Day of April, 2002

*Attest:*

*Attesting Officer*

JAMES E. ROGAN
*Director of the United States Patent and Trademark Office*

UNITED STATES PATENT AND TRADEMARK OFFICE

CERTIFICATE OF CORRECTION

PATENT NO. : 6,132,858
DATED : October 17, 2000
INVENTOR(S) : Steven D. Kloos

It is certified that error appears in the above-identified patent and that said Letters Patent is hereby corrected as shown below:

Title page,
Item [73], Assignee: delete "Omonics, Inc.", insert -- Osmonics, Inc. --

Column 12,
Line 14, delete "bout", insert -- about --
Line 60, delete "bout", insert -- about --

This certificate supersedes Certificate of Correction issued April 16, 2002.

Signed and Sealed this

Twentieth Day of August, 2002

*Attest:*

*Attesting Officer*

JAMES E. ROGAN
*Director of the United States Patent and Trademark Office*